United States Patent [19]

Huang

[11] Patent Number: 4,765,678

[45] Date of Patent: Aug. 23, 1988

[54] COLLAPSIBLE SETTEE

[76] Inventor: James Huang, No. 14, Valley 2, Lane 65, Ta Yeh Road, Taipei, Taiwan

[21] Appl. No.: 40,766

[22] Filed: Apr. 14, 1987

[51] Int. Cl.[4] ..... A47C 15/00

[52] U.S. Cl. ..... 297/236; 5/18 R; 5/185; 297/257

[58] Field of Search ..... 297/232, 233, 234, 235, 297/236, 237, 257; 5/18 R, 20, 183, 185, 202

[56] References Cited

U.S. PATENT DOCUMENTS

| | | | |
|---|---|---|---|
| 1,876,743 | 9/1932 | Pilates | 5/202 X |
| 2,699,202 | 1/1955 | Leary et al. | 297/236 X |
| 2,741,804 | 4/1956 | Eucker | 297/236 X |
| 3,743,351 | 7/1973 | Harris | 297/233 X |
| 4,032,999 | 7/1977 | Pringle | 5/18 R X |
| 4,045,829 | 9/1977 | Pringle | 5/18 R |
| 4,067,073 | 1/1978 | Komarov | 5/18 R X |
| 4,543,675 | 10/1985 | Shrock | 5/18 R X |

FOREIGN PATENT DOCUMENTS

| | | | |
|---|---|---|---|
| 2940725 | 4/1980 | Fed. Rep. of Germany | 5/18 R |
| 2932251 | 2/1981 | Fed. Rep. of Germany | 5/18 R |
| 5087 | of 1914 | United Kingdom | 297/236 |

*Primary Examiner*—Peter A. Aschenbrenner

*Assistant Examiner*—Thomas A. Rendos

*Attorney, Agent, or Firm*—Browdy and Neimark

[57] ABSTRACT

A collpasible settee having a plurality of seats which are foldable into a smaller number of seats, comprising a rectangular settee frame having a substantial frame for two collapsible seat frames; both ends of the settee frame are connected to a conventional permanently upholstered frame; a crook groove is formed on each of two end walls of the settee frame at a side facing each other; two crook grooves are provided on a central wall; three longitudinal guiding blocks having channels are disposed on the settee frame; a runner longitudinally slidable on the channel is formed on each guiding block; two collapsible seat frames are disposed in two distinct interior sections of the settee frame; each collapsible seat frame has a shaft slidably received by the crook groove, a main frame, a foot-rest panel, and a back panel; and the settee is collapsible with the collapsible seat frames collapsed into folded state, the both end conventional parts of the settee are folded by sliding each end part in a direction toward the central wall, the two end parts are capable of sliding on the longitudinal guiding blocks and reaching each other at a location with respect to the central wall.

3 Claims, 5 Drawing Sheets

COLLAPSIBLE SETTEE

BACKGROUND OF THE INVENTION

This invention relates generally to a settee, and more particularly to a collapsible settee that can be extended to form a settee of three or four seats or folded into a settee of two seats.

Heretofore, various types of constructions have been known for making settee. In many cases, these constructions form a rigid assembly capable of being shipped from a manufacturing plant to a retail outlet and, subsequently, to a customer. However, because of the bulk of such furniture, transportation costs have usually been relatively expensive.

In addition, in those cases where an owner may wish to move a piece of settee from one location to a distant location, the bulk of the settee may present a problem, e.g. in securing the settee to an incommodious elevator of a building.

SUMMARY OF THE INVENTION

It is, therefore, an objective of the present invention to provide a collapsible settee which is capable of being readily extended and folded.

Another objective of the present invention is to provide a collapsible settee which can be shipped in a minimum of space.

Still another objective of the present invention is to provide a collapsible settee capable of being varied in the external feature so as to match the interior decoration of private home or the like.

These and other objectives will become apparent from the following detailed description taken in conjunction with the accompanying drawings.

DETAILED DESCRIPTION OF THE PREFERRED EMBODIMENTS

Figure 1:
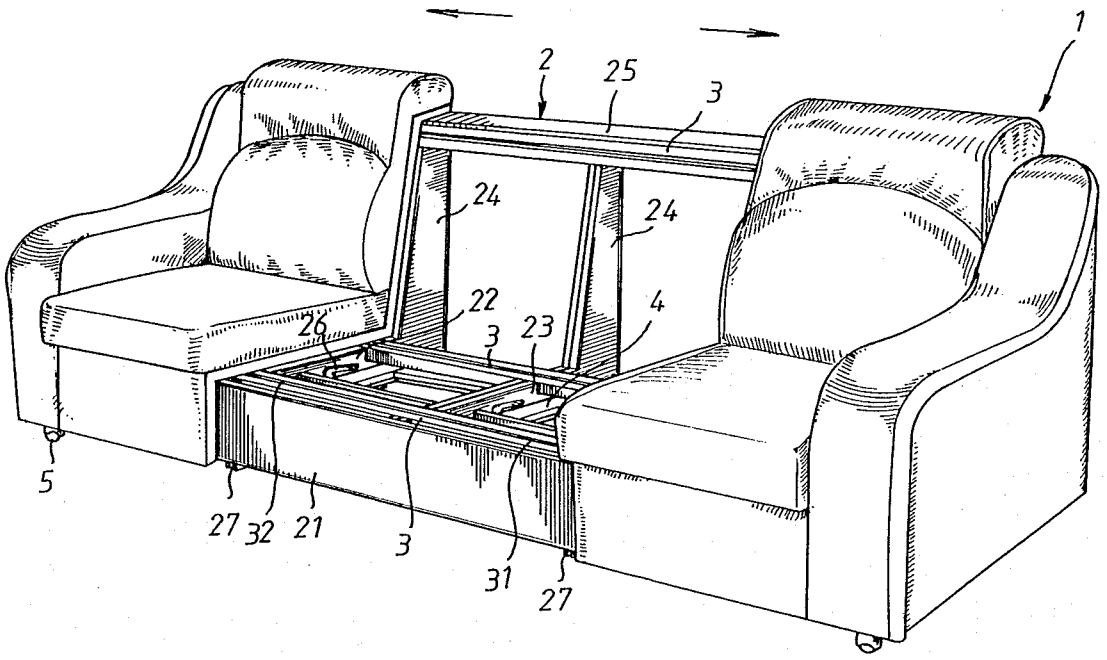
FIG. 1 is a perspective view of a collapsible settee in accordance with the present invention and which is shown in an extended state.

Referring to FIG. 1, a collapsible settee is shown in perspective at reference numeral 1. The settee 1 can be extended into a lengthened state as shown, in the direction as indicated by arrows. Accordingly, the frame hidden inside the hollow structure of the two terminal seats can be pulled out.

A settee frame 2 is preferably rectangular in structure. The settee frame 2 includes a longitudinal front wall 21, two parallel transverse end walls 22, a transverse central wall 23 being parallel to said end walls 22, three transverse back frames 24 connected to the transverse end and central walls 22, 23, and a longitudinal block 25 that joins the three back frames 24 at the uppermost position, forming a substantial frame for two collapsible seat frames 4. Each of the transverse end walls 22 and the central wall 23, joins a back frame 24 with a rear part of said walls 22 or 23, and a front, bottom part of said back frame 24 abuts along a joint on one side. Each end wall 22 is provided with a crook groove 26 at a side facing the interior of the settee frame. The central wall 23 comprises two crook grooves 26 with one on each side thereof. Four supporting legs 27 are disposed on the lower face of the settee frame 2 at the four corners with one on each corner. The settee frame 2 is connected at both ends thereof to a conventional frame which is permanently upholstered, as shown in FIG. 1.

Three longitudinal guiding blocks 3 having channels 31 therein are disposed on the settee frame 2. Two of said longitudinal guiding blocks 3 are disposed on the transverse end walls 22 and central wall 23, with one block at a front location and another block at a rear location, they are disposed with their channels 31 facing upward. A third block 3 is disposed on an upper location of the back frame 24. The third block 3 is disposed with its channel 31 facing forward. Each of the guiding blocks 3 is disposed on each of its corresponding walls or frames by dovetail joints or any other suitable engagements.

Each guiding block 3 comprises a runner 32 longitudinally slidable on the channel 31 thereof. A caster or the like may be attached to the lower face of the runner 32 to facilitate the sliding motion. In order to prevent accidental over sliding of the runner that may result in separation of the parts, the terminals of the channels 31 are provided with detent members (not shown).

Two collapsible seat frames 4 are disposed in the interior of the settee frame 2, as depicted in FIG. 1. The collapsible seat frame 4 is shown in a folded state.

Figure 2:
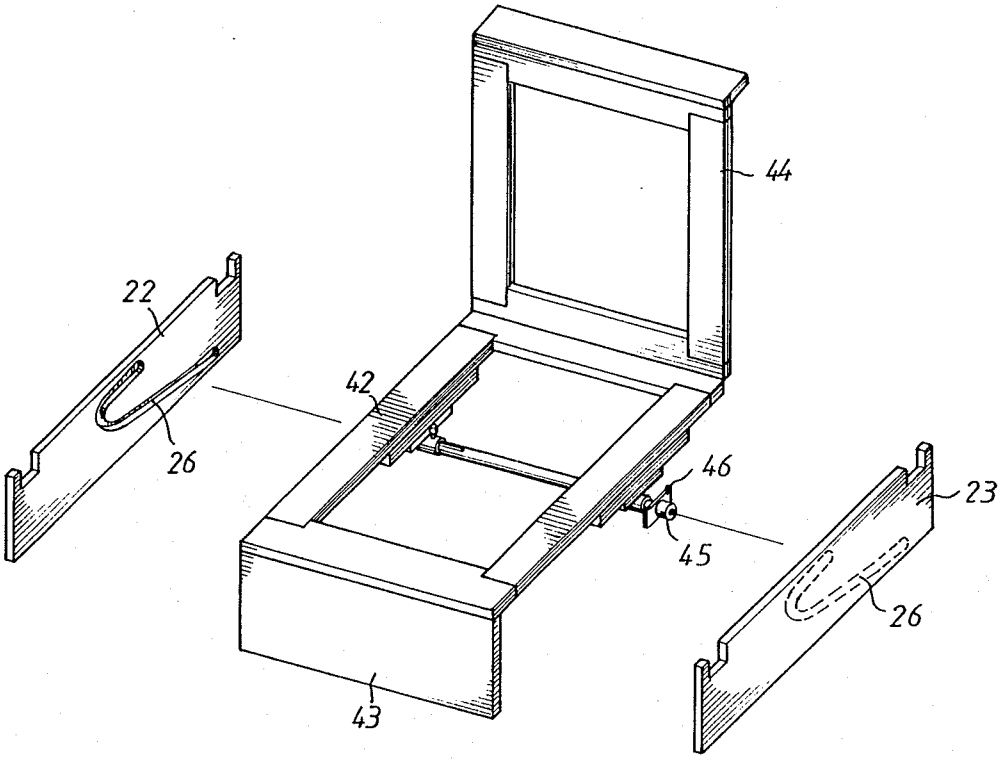
FIG. 2 is a perspective view showing the structure of a seat frame and its engagement with a transverse end wall and a central wall.
Figure 3:
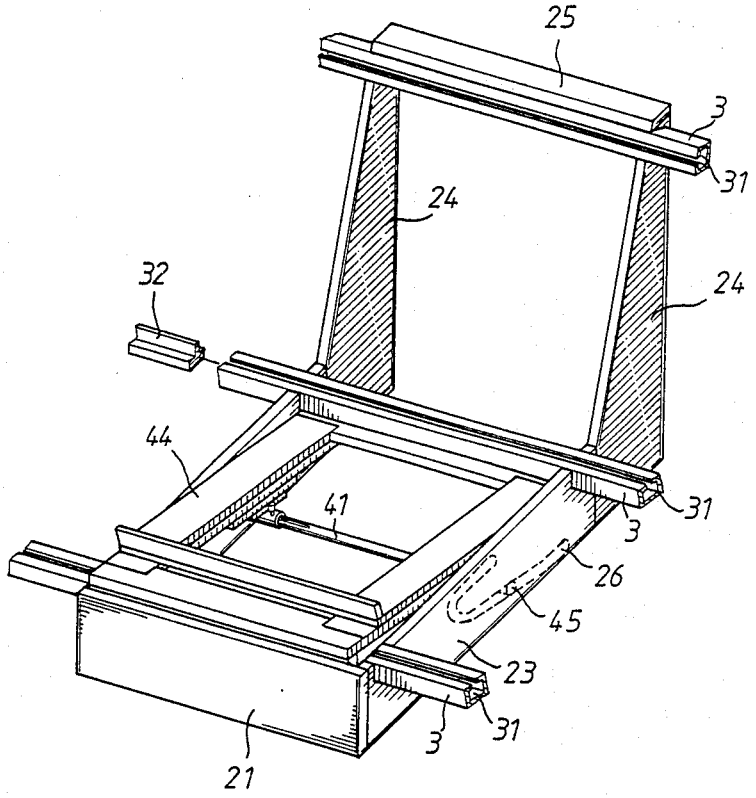
FIG. 3 is a fragmentary view of the settee in its FIG. 1 state but illustrating a seat frame body slightly lifted.

Referring to FIGS. 2 and 3, the seat frame 4 has a shaft 41. The shaft 41 is slidably received by the groove 26 disposed on the end walls 22 and central wall 23. Referring again to FIG. 2, it can be seen that each collapsible seat frame 4 includes a recangular main frame 42, a foot-rest panel 43 and a rectangular back panel 44. All these parts are latched or hinged together or are engaged by any other means with each other.

The shaft 41 is slidably received by the crook groove 26 of one of the end walls 22 and the central wall 23, with a caster 45 provided thereon to facilitate the sliding movement. A washer 46, preferably rectangular in shape, is disposed around the shaft 41 at a position adjacent to the ends thereof to prevent the shaft 41 from detaching off the end wall 22 or the central wall 23. Although not limited thereto, it is preferable that a shallow notch formed at both end portions of said shaft 41 with a combination sleeve with threaded hole thereon and bolt threadably received therein so as to avoid any possible rotational motion of the shaft 41.

Figure 4:
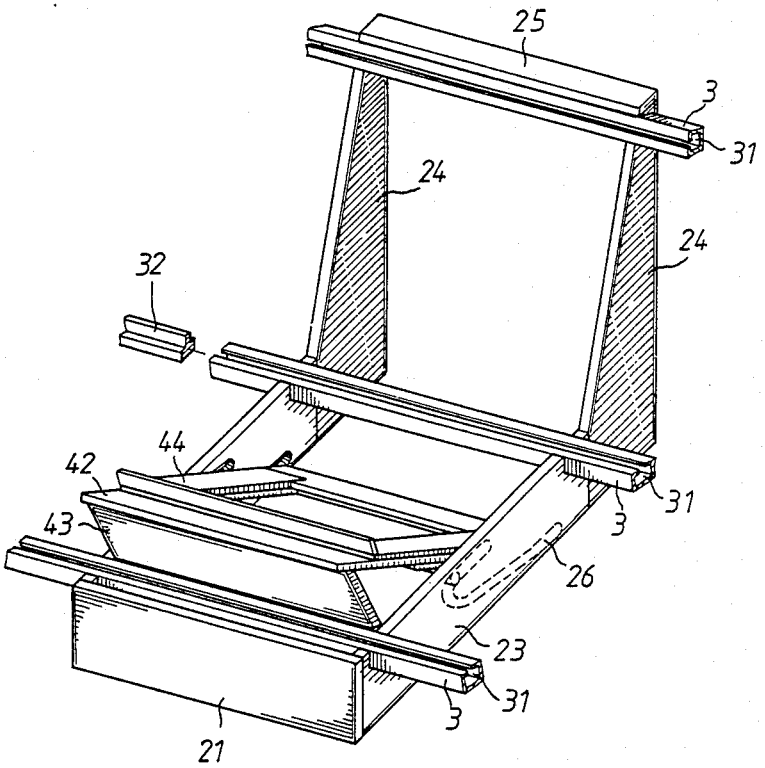
FIG. 4 is a view similar to FIG. 3 but illustrating a foot rest panel settled in suitable position.
Figure 5:
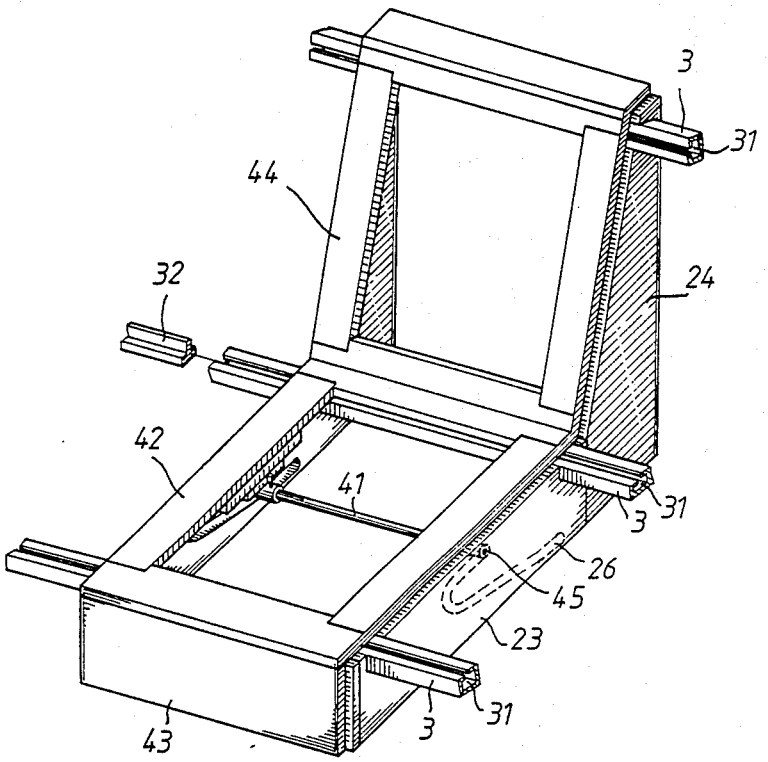
FIG. 5 is a view similar to FIG. 3 but showing a seat from as well as a back frame settled in suitable position.

With particular reference to FIGS. 3, 4 and 5, the way the collapsible seat frame 4 is extended is clearly depicted. The collapsible seat frame 4 originally in folded state (see FIG. 1) is, at first, slightly lifted at the front portion, as in FIG. 3. The shaft 41, originally having both ends at the lower terminals of each groove 26, slides to an upper portion. The foot-rest panel 43 is lifted out and rested on the longitudinal front wall 21 of the settee frame 2, as in FIG. 4. Accordingly, the rectangular back frame 44 is raised and rested on the back frame 24 and thus the whole collapsible seat frame 4 is set up, as in FIG. 5. The shaft 41 with the ends thereof at the upper position slides now to an upper terminal of each groove 26.

Four casters 5 are disposed on the corners of the lower base of the settee 1, with one on each corner so as to facilitate the sliding movement oppose the floor.

After the collapsible seat frame 4 has been set up, an upholstered horizontal panel or sheet is employed to cover the seat frame. Thereafter, a cushion is placed on the panel to form a settee of four seats.

To fold the four seats into two seats, the sequence is reversed. The cushion and the upholstered horizontal panels are removed and the two collapsible seat frames 4 are collapsed into their folded state. Thereafter, both tend conventional parts of the settee 1, which are slightly greater in size than the settee frame 2, are folded by sliding each end part in a direction toward the central wall 23. The two end parts are capable of sliding on the longitudinal guiding blocks 3 and finally reach each other at the location of the central wall 23.

Still another arrangement of the collapsible settee 1 provides a sette of three seats by extending only one side of the settee with the other side unextended.

In another preferred embodiment, a settee having two seats is produced which can be folded into a single seat settee.

Various other modifications may be made without departing from the scope of the present invention. For example, alternative forms of walls and panels could be utilized, and such panels may have various arrangements of internal reinforcement if required.

I claim:

1. A collapsbile settee (1) having a plurality of seats which are foldable into a smaller number of seats, comprising:

(a) a rectangular settee frame (2) including a longitudinal front wall (21), two parallel transverse end walls (22), a transverse central wall (23) being parallel to said end walls (22), three transverse back frames (24) connected to said transverse end walls (22) and said central wall (23), and a longitudinal block (25) that joins said three back frames (24) at an uppermost position thereof, forming a substantial frame for two collapsible seat frames (4); said settee frame (2) being connected at the both ends thereof to a conventional permanently upholstered frame;

(b) a crook groove (26) being formed on each end wall (22) at a side facing each other; two crook grooves (26) being provided on said central wall (23) with one on each side thereof;

(c) three longitudinal guiding blocks (3) having channels (31) therein disposed on said settee frame (2), two said blocks (3) being disposed on said transverse end walls (22) and said central wall (23) with the channels (31) thereof facing upward; a third block (3) being disposed on an upper location of said back frame (24) with the channel (31) thereof facing a front side;

(d) a runner (32) longitudinally slidable on said channel (31) of each guiding block (3);

(e) two collapsible seat frames (4) disposed in two distinct interior sections of said settee frame (2); each collapsible seat frame (4) having a shaft (41) slidably received by said grooves (26), a rectangular main frame (42), a foot-rest panel (43), and a rectangular back panel (44);

(f) a caster (45) disposed on each end of said shaft (41) to facilitate the sliding movement thereof; and (g) a rectangular washer (46) disposed around said shaft (41) at a position adjacent to said ends thereof to prevent said shaft (41) from detaching off said end walls (22) or said central wall (23);

(f) said settee being collapsbile with said collapsible seat frames (4) collapsed into folded state, said both end conventional parts of said settee (1) being folded by sliding each end part in a direction toward said central wall (23), said two end parts being capable of sliding on said longitudinal guiding blocks (3) and reaching each other at a location with respect to said central wall (23).

2. A collapsible settee (1) as set forth in claim 1, wherein each of said transverse end walls (22) and said central wall (23) join a back frame (24) with a rear part of said walls (22) or (23), and a frontward, bottom part of said back frame (24) abuts along a joint on one side.

3. A collapsible settee (1) as set forth in claim 1, wherein four supporting legs (27) are disposed on said lower face of said settee frame (2) at said four corners with one supporting leg (27) on each corner.

* * * * *